US005552365A

United States Patent [19]

Berneth et al.

[11] Patent Number: 5,552,365

[45] Date of Patent: Sep. 3, 1996

[54] PRESSURE-SENSITIVE RECORDING MATERIAL WHICH COMPRISES NATURAL OILS AND/OR DERIVATIVES THEREOF

[75] Inventors: Horst Berneth, Leverkusen; Günter Klug, Monheim; Jürgen Weisser, Dormagen, all of Germany

[73] Assignee: Bayer Aktiengesellschaft, Leverkusen, Germany

[21] Appl. No.: 401,841

[22] Filed: Mar. 10, 1995

[30] Foreign Application Priority Data

Mar. 18, 1994 [DE] Germany ..... 44 09 265.2

[51] Int. Cl.[6] ..... B41M 5/165

[52] U.S. Cl. ..... 503/213; 503/215; 503/218; 503/220; 503/221; 503/223; 503/224

[58] Field of Search ..... 427/150, 151, 427/152; 503/213, 218, 220, 221, 223, 224

[56] References Cited

U.S. PATENT DOCUMENTS

| | | | |
|---|---|---|---|
| 4,831,141 | 5/1989 | Berneth et al. | 544/90 |
| 4,835,270 | 5/1989 | Berneth | 544/73 |
| 4,904,637 | 1/1990 | Berneth et al. | 503/218 |
| 4,920,220 | 4/1990 | Phaff | 544/90 |
| 5,092,925 | 3/1992 | Berneth et al. | 106/21 R |
| 5,178,670 | 1/1993 | Klug et al. | 106/21 R |

FOREIGN PATENT DOCUMENTS

| | | | |
|---|---|---|---|
| 0262569 | 6/1988 | European Pat. Off. | 503/218 |
| 0316277 | 5/1989 | European Pat. Off. | 544/90 |
| 573210 | 8/1993 | European Pat. Off. | 503/213 |
| 3500361 | 7/1986 | Germany | 544/73 |
| 3622262 | 1/1988 | Germany | 544/90 |
| 3841668 | 6/1990 | Germany | 106/21 R |
| 4010641 | 10/1991 | Germany | 106/21 R |

*Primary Examiner*—Bruce H. Hess
*Attorney, Agent, or Firm*—Sprung Horn Kramer & Woods

[57] ABSTRACT

Particularly advantageous and environmentally compatible recording material comprises, in microencapsulated form, at least one 3,1-benzoxazine color donor dissolved in a solvent, and is characterized in that the solvent consists of one or more natural oils and/or one or more esters of fatty acids on which natural oils are based, or comprises such oils and/or esters.

14 Claims, No Drawings

PRESSURE-SENSITIVE RECORDING MATERIAL WHICH COMPRISES NATURAL OILS AND/OR DERIVATIVES THEREOF

The present invention relates to a pressure-sensitive recording material which comprises colour donors in microencapsulated form, the solvent for the colour donors comprising natural oils and/or derivatives thereof.

Pressure-sensitive recording material consists of, for example, at least one pair of sheets (of paper) which comprise a colour-forming agent or a mixture of colour-forming agents, dissolved or dispersed in a non-volatile organic solvent, and a developer. To prevent premature activation of the colour-forming agents present in the pressure-sensitive recording material, it is preferable to enclose these in microcapsules, which then break open only when pressure is applied by a writing or drawing instrument.

For example, such pressure-sensitive recording material can consist of two sheets of paper, the upper sheet being constructed, for example, as CB (coated back) paper, which is coated on its underside with microcapsules which comprise the colour-forming agent and an organic solvent. The lower sheet is then constructed as CF (coated front) paper, the upper side of which is coated with the developer.

In another design of pressure-sensitive recording material, so-called SC (self contained) paper, microcapsules, which comprise colour donors and solvents, and developers are applied together to the upper side of a sheet and are covered with an uncoated sheet of paper.

In both cases, colour-forming agent solution emerges from the capsules destroyed by mechanical pressure on the surface and, in contact with the developer, results in an image-wise coloured marking.

Suitable capsule materials are, for example, gelatin/gum arabic, polyamides, polyurethanes, polyureas, polysulphonamides, polyesters, polycarbonates, polysulphonates, polyacrylates and phenol-, melamine- and urea-formaldehyde condensates, such as are described, for example, in M. Gutcho, Capsule Technology and Microencapsulation, Noyes Data Co. 1972; G. Baster, Microencapsulation, Processes and Applications, publisher J. E. Vandegaar, and in DE-A 2,237,545 and 2,119,933. Microcapsules which have shells consisting of polyaddition products of polyisocyanates and polyamines are particularly advantageous. Polyisocyanates, polyamines, solvents, and suitable preparation processes for the microcapsules mentioned last are described, for example, in DE-A 3,203,059.

Possible developers are, for example, clays, acid-modified clays, oxides and acid salts, as well as monomeric, resinous and polymeric phenols, carboxylic acids or metal salts of carboxylic acids.

3,1-Benzoxazines are known as colour-forming agents, for example, from DE-A 3,500,361, DE-A 3,622,262 and EP-A 316,277. Mixtures of 3,1-benzoxazines with colour-forming agents from the series consisting of fluoranes and diindolyllactones are known, for example, from DE-A 3,841,668 and DE-A 4,010,641.

Solvents which are employed for the colour-forming agents in microcapsules are usually aromatic hydrocarbons, alkylated aromatic hydrocarbons, esters and aliphatic chlorinated hydrocarbons, for example partly hydrogenated terphenyl, alkylated naphthalenes and biphenyls, dibutylphthalate and partly chlorinated paraffins. These solvents can be mixed with one another and, if appropriate, also with other solvents.

Since contact between the skin and the contents of the microcapsules cannot be avoided completely when working with pressure-sensitive recording materials, there is a need to replace the solvent entirely or partly with natural products. Natural oils are a conceivable solution to the problem here.

Such oils have been described in EP-A 262,569 as solvents for microencapsulated colour-forming agents. The colour-forming agents employed there, however, are exclusively carbinol bases and carbinol ethers of triphenylmethane dyestuffs. Such colour-forming agents have, however, use properties which are not completely satisfactory.

Specific natural oils having a melting point of 20° to 25° C. are mentioned as solvents for colour-forming agents in EP-A-573,210. Possible colour-forming agents in that publication are phthalides, fluoranes, spiropyrans and a specific 3,1-benzoxazine. As can be seen from the examples of this EP-A, good results are obtained only if the colour-forming agent comprises a mixture of 4 to 5 individual components of the series consisting of blue phthalides (CVL, green and black fluoranes, red bis-indolylphthalides and, if appropriate, a black 3,1-benzoxazine).

Colour-forming agents having good use properties are 3,1benzoxazines, fluoranes and diindollylactones. However, these are compounds having structural elements of pronounced polarity. It was therefore to be expected that, in contrast to the almost non-polar triphenylmethane carbinol bases and ethers, these colour-forming agents dissolve only inadequately in natural oils.

Since multi-component mixtures of polar colour-forming agents have a better solubility and lower tendency to crystallization than individual polar colour-forming agents, according to EP-A-573,210 such 4-component mixtures of polar colour-forming agents are employed to provide favourable circumstances in respect of solubility and tendency to crystallization. Other use properties, for example the depth of colour, light-fastnesses and neutral shades which can be achieved, do not require such 4-component mixtures, since it is known, for example, from DE-A-3,500,361, DE-A-3,622,262, EP-A-316,277, DE-A-3,841,668 and DE-A-4,010,641, that individual 3,1-benzoxazine colour-forming agents or mixtures thereof with fluoranes and/or phthalides having contents of an individual 3,1-benzoxazine of more than 50% by weight have good use properties in combination with customary solvents.

Pressure-sensitive recording material has now been found which comprises as the colour donor, in microencapsulated form and dissolved in a solvent, at least one 3,1-benzoxazine of the formula (I)

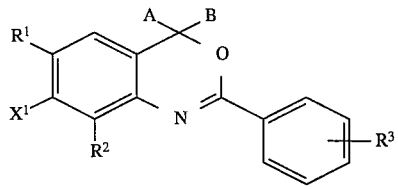

(I)

in which

A denotes a radical of the formulae (II) or (III) and

B denotes a radical of the formulae (III) or (IV)

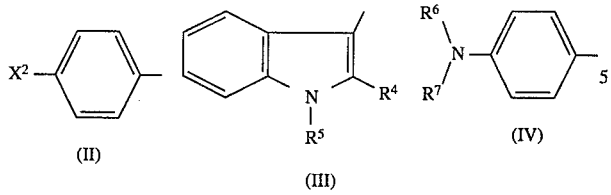

(II) (III) (IV)

$X^1$ denotes hydrogen, halogen, nitro, cyano, $C_1$–$C_4$-alkyl, $OR^8$ or $NR^9R^{10}$, $X^2$ denotes hydrogen, halogen, $C_1$–$C_4$-alkyl or $OR^8$, $R^1$ to $R^3$ independently of one another in each case denote hydrogen, halogen, $C_1$–$C_4$-alkyl or $OR^8$ and $R^4$ to $R^{10}$ independently of one another in each case denote $C_1$–$C_8$-alkyl, cyclohexyl, benzyl or phenyl, wherein the groups $NR^6R^7$ and $NR^9R^{10}$ independently of one another can in each case also denote pyrrolidino, piperidino or morpholino, with the proviso that the following do not occur simultaneously:

A represents a radical of the formula (II),

B represents a radical of the formula (IV), $X^1$ represents dimethylamino, $X^2$ represents methoxy, $R^3$ represents hydrogen, $R^6$ and $R^7$ represent ethyl and one of the radicals $R^1$ and $R^2$ represents methyl and the other represents hydrogen, which is characterized in that the solvent consists of one or more natural oils and/or one or more esters of fatty acids on which natural oils are based, or it comprises such oils and/or esters.

Surprisingly, it has been found that 3,1-benzoxazines by themselves and also mixtures thereof with fluoranes and/or diindolyllactones are readily soluble in natural oils and form stable solutions which can be microencapsulated. The pressure-sensitive recording materials prepared with these compounds can be used in the customary manner and produce deep-coloured light-fast copies.

In comparison with the use of conventional solvents, an image which has a significantly more neutral shade after exposure of the CF or CB side is surprisingly obtained with recording materials according to the invention. In addition, after exposure of the CB side, the image displays a higher intensity than when conventional solvents are used. These light-fastnesses are particularly important with colour-forming agents which develop to give a black colour.

Recording materials according to the invention furthermore are surprisingly more stable to ageing processes, especially to damp/heat ageing. After storage at below 70° C./75% relative atmospheric humidity for several days, they produce more intensive images than when conventional solvents are used.

Finally, the microcapsules in recording materials according to the invention are more impermeable and can be prepared with less emulsifying energy than conventional microcapsules.

All the abovementioned advantages are particularly surprising since it is known from EP-A-573,210 that the mixtures of colour-forming agents mentioned therein are less effective in the natural oils mentioned therein and can be employed only satisfactorily, but with certain problems. In particular, poor results for the stability to ageing in the presence of moisture are reported there.

Possible natural oils are those of plant and animal origin, such as coconut fat (oil), palm oil, sunflower oil, rape oil, olive oil, sesame oil, soya oil, linseed oil, castor oil, cottonseed oil, groundnut oil or fish oil. Esters of fatty acids on which such oils are based are also suitable, such as rapeseed oil fatty acid methyl ester, methyl oleate, 2-ethylhexyl cocoate, isopropyl myristate, propylene glycol dicaprylate/caprate or methyl isostearate. These oils and/or esters can be employed individually, as mixtures with one another and/or as mixtures with paraffinic and/or aromatic hydrocarbons. Mixtures with hydrocarbons preferably comprise at least 50% by weight of natural oils or esters of fatty acids on which such oils are based.

Preferred natural oils are coconut fat (oil), palm oil, rapeseed oil, sesame oil and soya oil. Preferred hydrocarbons are paraffinic hydrocarbons, in particular branched paraffinic hydrocarbons, for example so-called white oil.

Coconut fat (oil) and coconut fat/white oil mixtures are particularly preferred. The content of white oil in such mixtures can be, for example, between 1 and 50% by weight, and is preferably between 10 and 40% by weight.

Pressure-sensitive recording materials according to the invention which comprise several types of colour donor are characterized in that they additionally comprise as colour donors at least one compound from the group consisting of fluoranes of the formulae (V) and (VI) and diindolyllactones of the formula (VII)

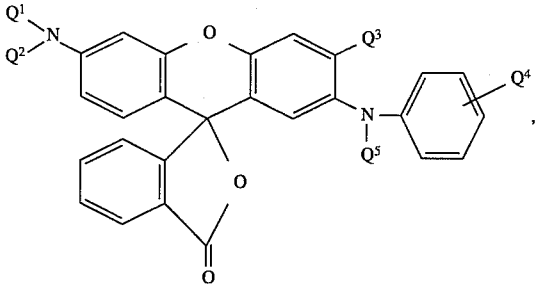

(V)

$Q^1$ and $Q^2$ independently of one another in each case denote hydrogen, straight-chain or branched $C_1$–$C_8$-alkyl, allyl, cyclopentyl or cyclohexyl, it being possible for alkyl groups to be optionally substituted by up to 3 identical or different substituents from the group consisting of $C_1$–$C_3$-alkoxy, cyclohexyl, phenyl, furanyl, pyrrolyl and pyridinyl and it also being possible for furanyl, pyrrolyl and pyridinyl to be present incompletely or partly hydrogenated form, or $NQ^1Q^2$ together denote pyrrolidino, piperidino or morpholino, $Q^3$ denotes hydrogen, methyl, methoxy or chlorine, $Q^4$ denotes hydrogen, methyl, trifluoromethyl, fluorine, chlorine, acetyl, cyano or anilino and $Q^5$ denotes hydrogen, methyl, ethyl or benzyl,

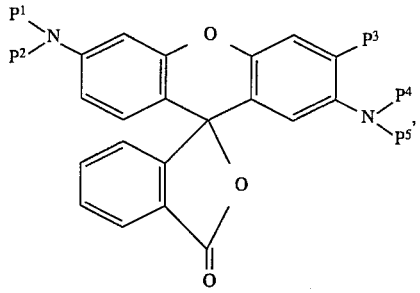

(VI)

$P^1$, $P^2$, $P^4$ and $P^5$ independently of one another in each case denote hydrogen, straight-chain or branched $C_1$–$C_{12}$-alkyl, allyl, cyclopentyl, cyclohexyl or phenyl, it being possible for alkyl groups to be optionally substituted by up to 3 identical or different substituents from the group consisting of $C_1$–$C_3$-alkoxy, cyclohexyl, phenyl, furanyl, pyrrolyl and pyridinyl and for phenyl groups to be optionally substituted by up to 2 identical or different substituents from the group consisting of methyl, methoxy and chlorine, and it also being possible for furanyl, pyrrolyl and pyridinyl to be present in completely or partly hydrogenated form, or $NP^1P^2$ together denotes pyrrolidino, piperidino or morpholino, and $P^3$ denotes hydrogen, methyl, methoxy or chlorine,

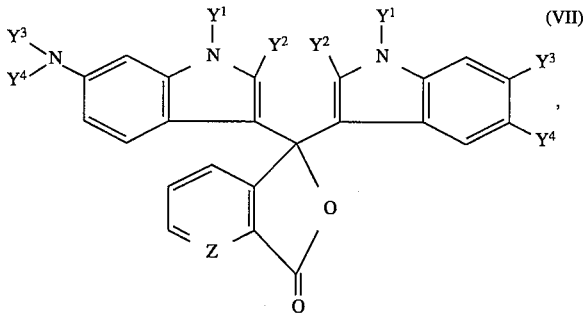

(VII)

$Y^1$ denotes straight-chain or branched $C_1$–$C_{12}$ -alkyl, benzyl or phenethyl, $Y^2$ denotes hydrogen, straight-chain or branched $C_1$–$C_4$-alkyl or phenyl, $Y^3$ and $Y^4$ independently of one another in each case denote hydrogen, chlorine, methyl or methoxy and Z denotes CH or N.

Such mixtures preferably comprise at least 50% by weight, preferably at least 65% by weight, of 3,1-benzoxazines of the formula (I) and not more than 2 compounds from the group consisting of fluoranes of the formulae (V) and (VI) and diindolyllactones of the formula (VII).

Preferred recording materials according to the invention are those in which, in the formulae (I) to (IV), $X^1$denotes hydrogen, chlorine, nitro, cyano, methyl, ethyl, methoxy, ethoxy, dimethylamino, diethylamino, N-methyl-N-cyclohexylamino, dibenzylamino, N-methyl-N-phenylamino, pyrrolidino, piperidino or morpholino, $X^2$ denotes hydrogen, chlorine, methyl, ethyl, methoxy, ethoxy, benzyloxy or phenoxy, $R^1$ to $R^3$ independently of one another in each case denote hydrogen, chlorine, methyl or methoxy, $R^4$ denotes methyl, ethyl, propyl, butyl, pentyl, hexyl, octyl or benzyl, $R^5$ denotes methyl, ethyl, cyclohexyl, or phenyl and the group $NR^6R^7$ denotes dimethylamino, diethylamino, dibenzylamino, N-methyl-N-phenylamino, pyrrolidino, piperidino or morpholino, with the proviso that the following do not occur simultaneously:

A represents a radical of the formula (II),

B represents a radical of the formula (IV), $X^1$ represents dimethylamino, $X^2$ represents methoxy, $R^3$ represents hydrogen, $R^6$ and $R^7$ represent ethyl and one of the radicals $R^1$ and $R^2$ represents methyl and the other represents hydrogen.

Particularly preferred recording materials according to the invention are characterized in that, in formula (I)

A denotes a radical of the formula (II) and

B denotes a radical of the formula (IV), $X^1$ denotes methoxy, ethoxy, benzyloxy, dimethylamino, pyrrolidino, piperidino or morpholino, $X^2$ denotes hydrogen, chlorine, methyl, methoxy, ethoxy or benzyloxy, $R^2$ and $R^3$ denote hydrogen, $R^1$ denotes chlorine, methyl or methoxy and the group $NR^6R^7$ denotes dimethylamino, diethylamino, dibenzylamino, pyrrolidino, piperidino or morpholino, with the proviso that the following do not occur simultaneously: $X^1$ represents dimethylamino, $X^2$ represents methoxy, $R^1$ represents methyl and $NR^6R^7$ represents diethylamino.

Preferred recording materials according to the invention are also those which comprise as the colour donor mixtures of benzoxazines which develop to give a black colour and fluoranes which develop to give a black colour, or mixtures of benzoxazines which develop to give a black colour, fluoranes which develop to give a green colour and benzoxazines or diindolyllactones which develop to give a red colour, or mixtures of benzoxazines which develop to give a green colour, fluoranes which develop to give a black colour and benzoxazines or diindolyllactones which develop to give a red colour. Such mixtures are distinguished by a more intensive imaging power in comparison with the individual components. Such mixtures furthermore have an improved light-fastness both in the developed state (CF side) and in the non-developed state (CB side), a change in colour shade in particular largely being avoided. In addition, any desired nuance of a black shade can be conveniently established with such mixtures.

The advantages of such colour donor mixtures are intensified by the solvents to be used according to the invention.

Particularly preferred recording materials according to the invention comprising colour donor mixtures comprise $a^1$) a 3,1-benzoxazine of the formula (I) wherein $X^1$ denotes dimethylamino, pyrrolidino, piperidino or morpholino and $X^2$ denotes methoxy, ethoxy or benzyloxy and the other radicals have the meaning given above as particularly preferred, or $a^2$) an isomer mixture of 3,1-benzoxazines of the formula (I), wherein, in one isomer, $R^1$ denotes chlorine, methyl or methoxy and $R^2$ denotes hydrogen, and in the other isomer, $R^1$ denotes hydrogen and $R^2$ denotes chlorine, methyl or methoxy, and in both isomers $X^1$ and $X^2$ have the meaning given above for $a^1$) and the other radicals have the meaning given initially as particularly preferred, and b) a fluorane of the formula (V) wherein $Q^1$ and $Q^2$ independently of one another in each case denote hydrogen, methyl, ethyl, 1- or 2-propyl, 1- or 2-butyl, 2-methyl-1-butyl, 1-, 2- or 3-pentyl, 3-methyl-1-butyl, 2-ethyl-1-propyl, 1-, 2- or 3 -hexyl, 3-methyl-1-pentyl, 2-methoxyethyl, 2 -ethoxyethyl, 3-methoxypropyl, 3-ethoxypropyl, 4 -methoxybutyl, 4-ethoxybutyl, cyclohexylmethyl, benzyl, furfuryl, pyrrolidin-2-yl-methyl, 2-(2- or 4-pyridyl)-ethyl, allyl, cyclopentyl or cyclohexyl, or $NQ^1Q^2$ together denotes pyrrolidino, piperidino or morpholino, $Q^3$ denotes hydrogen, methyl or chlorine, $Q^4$ denotes hydrogen, methyl, fluorine, chlorine or anilino and $Q^5$ denotes hydrogen or methyl.

Isomer mixtures according to $a^2$) are obtained as such during synthesis. They are therefore to be regarded as one substance.

Particularly preferred recording materials according to the invention comprising colour donor mixtures can also comprise a) a 3,1-benzoxazine as described above under $a^1$) or an isomer mixture of 3,1-benzoxazines described above under $a^2$) and b) a fluorane of the formula (VI) wherein $P^1$, $P^2$, $P^4$ and $P^5$ independently of one another in each case denote hydrogen, methyl, ethyl, 1- or 2-propyl, 1- or 2-butyl, 2-methyl-1-butyl, 1-, 2- or 3-pentyl, 3-methyl-1-butyl, 2-ethyl-1-propyl, 1-, 2- or 3-hexyl, 4-methyl-1-pentyl, 4-methoxyethyl, 3-ethoxyethyl, 3-methoxypropyl, 4-methoxybutyl, 4 -ethoxybutyl, cyclohexylmethyl, benzyl, furfuryl, pyrrolidin-2-yl-methyl, 2-(2- or 4-pyridyl)-ethyl, allyl, cyclopentyl, cyclohexyl, phenyl, 2- or 4-chlorophenyl, 2- or 4-tolyl or 2- or 4-anisyl, or $NP^1P^2$ together denotes pyrrolidino, piperidino or morpholino, and $P^3$ denotes hydrogen, methyl or chlorine, and $c^1$) a further benzoxazine of the formula (I) wherein $X^1$ and $X^2$ independently of one another denote methoxy, ethoxy or benzyloxy and the other radicals have the meaning given above as particularly preferred, or $c^2$) an isomer mixture of 3,1-benzoxazines of the formula (I) wherein in one isomer $R^1$ denotes chlorine, methyl and methoxy and $R^2$ denotes hydrogen and in the other isomer $R^1$ denotes hydrogen and $R^2$ denotes chlorine, methyl or methoxy, and $X^1$ and $X^2$ have the meaning given above for $c^1$) and the other radicals have the meaning given initially as particularly preferred, or $c^3$) a diindolyllactone of the formula (VII) wherein $Y^1$ denotes methyl, ethyl, 1- or 2-propyl, 1- or 2 -butyl, 1- or 2-pentyl, 1- or 2-hexyl, 1- or 2 -heptyl, 1- or 2-octyl or benzyl, $Y^2$ denotes hydrogen, methyl, ethyl, 1-propyl, 1-butyl or phenyl, $Y^3$ and $Y^4$ independently of one another in each case denote hydrogen, chlorine, methyl or methoxy and Z denotes CH or N.

Particularly preferred recording material, according to the invention comprising colour donor mixtures can also comprise a 3,1-benzoxazine of the formula (I) wherein $X^1$ denotes dimethylamino, pyrrolidino, piperidino or morpholino and $X^2$ denotes hydrogen, chlorine or methyl and the other radicals have the meaning given above as particularly preferred, or an isomer mixture of 3,1-benzoxazines of the formula (I) wherein in one isomer $R^1$ denotes chlorine, methyl or methoxy and $R^2$ denotes hydrogen and in the other isomer $R^1$ denotes hydrogen and $R^2$ denotes chlorine, methyl or methoxy, and in both isomers $X^1$ and $X^2$ have the meaning given immediately above and the other radicals have the meaning given initially as particularly preferred.

To obtain ready-to-use recording materials according to the present invention, for example, a paper can be coated with microcapsules which comprise colour-forming agents or mixtures of colour-forming agents to be used according to the invention in solvents or solvent mixtures to be used according to the invention and a CB paper can thus be prepared, and this can be brought into contact with commercially available CF paper which is coated with a developer. It is also possible to bring such microcapsules together with one of the abovementioned developers on the upper side of a paper in the customary manner and in this way to obtain an SC paper, which can be used in a duplicating set in the customary manner. The copy is formed during imagewise mechanical pressure on the surface by the colour-forming agent solution emerging from the capsules destroyed being developed on the surface of the CF or SC paper.

The quality of such copies can be determined, for example, by measurement of the reflection. In this procedure, for example, a copy can be made over a large area by destroying the capsules of a CB paper on the front side of a CF paper comprising the colour developer. The intensity of this copy can be determined with customary optical spectrophotometers, for example an E1 Repho 44381 from Carl Zeiss. The intensity is then obtained from the level of the absorption value. This is calculated from the formula $$\%\ \text{Absorption} = \frac{\%\ \text{Reflection}_{CF} - \%\ \text{Reflection}_{copy}}{\%\ \text{Reflection}_{CF}} \times 100$$

In this formula, % absorption=absorption value (corresponds to the intensity), % $\text{reflection}_{CF}$=reflection of the CF paper and % $\text{reflection}_{copy}$=reflection of the copy (corresponds to the impression).

To determine the light-fastnesses, the impression (CF fading) or the CB side coated with microcapsules (CB decline) can be irradiated with day-light lamps, for example, for 48 hours.

The intensity of the exposed impression (CF fading) can be determined as described above, and the colour shade can be compared with the original by visual inspection.

If the capsule-coated side of a CB paper is exposed to light, a copy can then be generated by exerting pressure. Its intensity (CB decline) can be determined as described above and compared analogously, together with the colour shade, with the copy of a non-exposed CB paper.

To determine the stability of the capsules of a CB paper to ageing, this can be stored, for example, at 70° C. and 75% relative atmospheric humidity for 12 days. A copy can then be generated by exerting pressure, the intensity (ageing) of the copy being determined as above and, together with the colour shade, compared with the copy of a CB paper stored in the dry at room temperature.

Copies which have originated from the colour-forming agents or mixtures of colour-forming agents to be used according to the invention in the solvents to be used according to the invention display a more neutral nuance, i.e. a smaller shift in colour shade, after ageing and during CF fading and CB decline and a higher colour intensity after ageing and during CB decline than when conventional solvents and/or other colour-forming agents are used.

Furthermore, the emulsification during preparation of microcapsules to be used according to the invention requires considerably less energy than the emulsification during the preparation of microcapsules comprising customary colour-forming agents and solvents. For example, using a commercially available laboratory emulsifying apparatus of the type MT 48/260 (manufacturer Kinematika), it was found that to generate a droplet size of 7 μm, instead of the 9000 revolutions per minute otherwise customary, only about 6000 revolutions per minute were necessary for preparation of microcapsules to be used according to the invention.

The microcapsules to be used according to the invention also have a higher density.

EXAMPLES

EXAMPLE A

Preparation of the microcapsule dispersions used 26 g of 3,5-bis-(6-isocyanato-hexyl)-2H-1,3,5-oxadiazine- 2,4,6-(3H,5H)-trione were stirred into 174 g of a colour donor solution which comprised 5% by weight of colour donor in a solvent. This mixture was emulsified with 251 g of a 1% strength by weight aqueous solution of a polyvinyl alcohol (Mowiol® 26/88) in a rotor-stator dispersing apparatus such that an emulsion having an average drop size of 7 μm was obtained. 49 g were then added into 9% strength by weight aqueous diethylenetriamine solution, while stirring and the mixture was heat-treated at 60° C. for 2 hours. Microcapsule dispersions having a dry content of 39.8% by weight were thus obtained.

EXAMPLE B

Preparation of the CB papers used 2.1 g of a customary spacer based on cellulose, for example Arbocell® BE 600/30, 2.0 g of a customary binder, for example a styrene/butadiene latex, and 16.3 g of water were stirred into 12.9 g of a microcapsule dispersion obtained according to Example A. This mixture was applied to a base paper (40 g/m$^2$) by means of a 40 μm doctor blade and dried. A CB paper having a coating weight of about 5.5 g/m$^2$ was thus obtained.

EXAMPLE C

Production of copies

The CB papers prepared according to Example B were brought into contact in the customary manner with a commercially available CF paper, the receiver layer of which comprised activated clay (Reacto®, Köhler). Copies were formed here by 304 impressions of the letter "w" over a field of 4×4 cm$^2$ in the narrowest possible script using an electric typewriter from Olympia Werke AG, Wilhelmshaven, model Olympia SGED 52 at the lowest striking intensity.

The intensity was calculated in accordance with the abovementioned formula from the reflection of the 4th copy of a set in which sheet 1 to 3 comprised a base paper (46 g/m$^2$), sheet 4 comprised the CB paper prepared according to Example 3 and sheet 5 comprised a commercially available CF paper.

EXAMPLE D

Exposure test

A copy prepared according to Example C or a CB paper prepared according to Example B was irradiated with four 18 W fluorescent tubes (Sylvania-Luxline® ES, daylight deluxe) in a box for 48 hours.

EXAMPLE E

Ageing test

A CB paper prepared according to Example B was stored at a temperature of 70° C. and a relative atmospheric humidity of 75% in a commercially available climatically controlled cabinet. After a storage time of 12 days, a sample of the aged paper was used for duplication on a commercially available fresh CF paper and measured as described in Example C.

EXAMPLE F

Capsule impermeability test 5.7 parts by weight of a microcapsule dispersion prepared according to Example A were mixed with 8.5 parts by weight of water and 13.3 parts by weight of silica sol (silica sol F 300 from Bayer AG or Ludox® HS 40 from Dupont). About 5 ml of the homogeneous mixture were applied to a standard base paper (about 40 g/m$^2$) by means of a wire doctor blade, as described in Example B, and then dried by means of hot air. The discoloration of the paper was measured optically, as described above. For evaluation: the lower the absorption value measured, the higher the impermeability of the microcapsule wall.

EXAMPLE G

Colour-forming agents employed

Colour-forming agent 1: Mixture of 90 parts by weight of a compound of the formula (I) where A=p-ethoxyphenyl, B=p-diethylanilino, $X^1$=dimethylamino, $R^1$=methyl and $R^2$=$R^3$=hydrogen with 10 parts by weight of the isomeric compound where $R^1$=hydrogen and $R^2$=methyl.

Colour-forming agent 2: Compound of the formula (V) where $Q^1$=$Q^2$=ethyl, $Q^3$=methyl and $Q^4$=$Q^5$=hydrogen.

Colour-forming agent 3: Compound of the formula (VI) where $P^1$=$P^2$=ethyl, $P^3$=hydrogen and $P^4$=$P^5$=benzyl.

Colour-forming agent 4: Compound of the formula (VII) where $Y^1C_8H_{17}$, $Y^2$=methyl $Y^3$=$Y^4$=hydrogen and Z=CH.

Colour-forming agent 5: Compound of the formula (I) where A=p-methoxyphenyl, B=p-diethylanilino, $X^1$=methoxy, $R^1$=methyl, $R^2$=hydrogen and $R^3$=p-chloro.

EXAMPLES 1 TO 6 (for comparison)

Pressure-sensitive recording materials were prepared and tested in accordance with the statements in the description and Examples A to G using solvents which are not to be used according to the invention. Details can be seen in Table 1.

TABLE 1

| Example No. | Colour-forming agent (% by weight) | Solvent (% by weight) | Copy: Colour shade | Copy: Intensity (%) | CF fading: Colour shade | CF fading: Intensity (%) |
|---|---|---|---|---|---|---|
| 1 | 1 (100) | 1 (80)<br>2 (20) | bluish-black | 44.7 | green | 37.0 |
| 2 | 1 (67)<br>2 (33) | 1 (100) | black | 45.5 | greenish-tinged dark grey | 37.3 |
| 3 | 1 (67)<br>2 (33) | 1 (60)<br>3 (40) | black | 49.2 | greenish-tinged black | 39.1 |
| 4 | 1 (70)<br>3 (18)<br>4 (12) | 1 (100) | black | 44.7 | greenish-tinged grey | 33.1 |
| 5 | 1 (70)<br>3 (18)<br>4 (12) | 1 (60)<br>3 (40) | black | 41.8 | reddish-grey | 33.1 |

TABLE 1-continued

| | | | | | | |
|---|---|---|---|---|---|---|
| 6 | 1 (70)<br>3 (18)<br>5 (12) | 2 (20)<br>4 (80) | black | 50.3 | black | 41.8 |

| Example No. | CB decline Colour shade | CB decline Intensity (%) | Ageing Colour shade | Ageing Intensity (%) | Capsule impermeability (intensity %) Immediate | Capsule impermeability (intensity %) after 2 days | Comparison with Example No. |
|---|---|---|---|---|---|---|---|
| 1 | violet-tinged black | 36.6 | greenish-grey | 33.8 | 2.5 | 6.7 | 7 to 12 |
| 2 | reddish-grey | 31.4 | black | 35.4 | 2.0 | 6.3 | 13 |
| 3 | grey | 34.2 | greenish-black | 31.9 | 5.3 | 13.2 | 14 |
| 4 | red | 24.3 | slightly greenish-tinged black | 24.5 | 2.7 | 6.6 | 15 |
| 5 | green | 35.0 | black | 25.3 | 1.8 | 5.5 | 16 |
| 6 | black | 42.0 | black | 30.5 | 2.5 | 6.9 | 17 |

Key to Table 1: Intense = intensity; solvent 1 = diisopropylnaphthalene (isomer mixture), 2 = hydrogenated naphthenes, 3 = white oil, 4 = chloro paraffin.

EXAMPLES 7 TO 17

The procedure was analogous to Examples 1 to 6, but solvents to be employed according to the invention were used. Details can be seen in Table 2.

TABLE 2

| Example No. | Colour-forming agent (% by weight) | Solvent (% by weight) | Copy Colour shade | Copy Intensity (%) | CF fading Colour shade | CF fading Intensity (%) | CB decline Colour shade | CB decline Intensity (%) | Ageing Colour shade | Ageing Intensity (%) | Capsule impermeability (intensity %) Immediate | Capsule impermeability (intensity %) after 2 days |
|---|---|---|---|---|---|---|---|---|---|---|---|---|
| 7 | 1 (100) | 5 (100) | bluish-black | 49.0 | greenish-black | 40.6 | black | 40.0 | bluish-black | 44.2 | 1.4 | 3.6 |
| 8 | 1 (100) | 6 (100) | bluish-black | 53.5 | greenish-black | 43.5 | black | 44.3 | bluish-black | 44.3 | 2.6 | 5.6 |
| 9 | 1 (100) | 7 (100) | bluish-black | 50.8 | greenish-dark grey | 38.2 | dark grey | 39.1 | greenish-grey | 16.0 | 2.5 | 4.7 |
| 10 | 1 (100) | 8 (100) | bluish-black | 45.6 | greenish-black | 39.2 | black | 40.1 | bluish-black | 36.7 | 1.1 | 1.8 |
| 11 | 1 (100) | 9 (100) | bluish-black | 48.8 | greenish-black | 40.0 | dark grey | 38.3 | greenish-dark grey | 29.7 | 1.3 | 2.5 |
| 12 | 1 (100) | 10 (100) | bluish-black | 47.0 | greenish-black | 38.9 | black | 39.5 | bluish-black | 38.3 | 2.1 | 4.2 |
| 13 | 1 (67)<br>2 (33) | 5 (30) | black | 42.7 | grey | 29.1 | dark grey | 36.4 | black | 43.8 | 1.8 | 4.6 |
| 14 | 2 (33)<br>2 (33) | 5 (70) | black | 41.0 | grey | 24.8 | dark grey | 38.4 | black | 44.2 | 2.3 | 7.8 |
| 15 | 1 (70)<br>3 (18)<br>4 (12) | 5 (100) | black | 39.7 | grey | 26.1 | reddish-grey | 34.5 | black | 44.8 | 1.4 | 4.6 |
| 16 | 1 (70)<br>3 (18)<br>4 (12) | 3 (30)<br>5 (70) | black | 41.2 | grey | 24.3 | dark grey | 37.7 | black | 41.3 | 0.7 | 3.7 |
| 17 | 1 (70)<br>3 (18)<br>5 (12) | 3 (25)<br>6 (75) | black | 47.3 | dark | 40.5 | dark grey | 41.1 | black | 45.2 | 1.8 | 4.3 |

Key to Table 2: Intense = intensity; solvent 3 = white oil, 5 = coconut fat (oil), 6 = rape oil, 7 = sunflower oil, 8 = palm oil, 9 = soya oil, 10 = sesame oil.

TABLE 3

Examples 18 to 34:
The procedure was as in Examples 1 to 17, but in Examples 18 to 29, colour-forming agents of the formula (I) where A = (II) and B = (IV) were employed and in Examples 30 to 34, colour-forming agents of the formula (I) where A = (III) and B = (IV) were employed, in each case in combination with the stated solvents. The results were analogous to Examples 7 to 17. Details can be seen in Table 3.

| Example | | | | | | $R^6$ | $R^7$ from Example 30 | Solvent |
|---|---|---|---|---|---|---|---|---|
| No. | $X^1$ | $X^2$ | $R^1$ | $R^2$ | $R^3$ | $R^4$ | $R^5$ | (% by weight) |
| 18 | $N(CH_3)_2$ | $OC_4H_9$ | $OCH_3$ | H | p-Cl | $CH_3$ | $CH_3$ | 5 (100) |
| 19 | " | $OCH_3$ | H | $CH_3$ | p-$CH_3$ | " | $CH(CH_3)_2$ | 3 (30), 9 (70) |
| 20 | " | " | Cl | H | H | $C_2H_5$ | $C_2H_5$ | 3 (40), 6 (60) |
| 21 | Pyrrolidino | H | $CH_3$(H*) | H($CH_3$*) | H | " | " | 3 (40), 8 (30), 5 (30) |
| 22 | $N(CH_3)_2$ | Cl | $CH_3$(H*) | H($CH_3$*) | H | " | " | 10 (100) |
| 23 | $N(C_2H_5)_2$ | $CH_3$ | H | H | p-Cl | $CH_3$ | Phenyl | 6 (70), 9 (30) |
| 24 | $OC_2H_5$ | $OCH_3$ | $CH_3$ | H | " | $C_4H_9$ | $C_4H_9$ | 2 (35), 5 (65) |
| 25 | Piperidino | $OCH_3$ | $CH_3$(H*) | H($CH_3$*) | H | $C_2H_5$ | $C_2H_5$ | 5 (100) |
| 26 | $OCH_3$ | Cl | $OC_2H_5$ | H | H | $C_2H_5$ | $C_2H_5$ | 1 (40), 11 (10), 8 (50) |
| 27 | Dibenzyl-amino | H | H | H | p-$OCH_3$ | $CH_3$ | $CH_3$ | 3 (40), 7 (60) |
| 28 | $OCH_3$ | $OCH_3$ | $OCH_3$ | H | p-Cl | $C_2H_5$ | $C_2H_5$ | 3 (30), 5 (70) |
| 29 | $N(CH_3)_2$ | $OCH(CH_3)_2$ | H | H | H | —$(CH_2)_5$— | | 3 (30), 6 (70) |
| 30 | H | — | H | H | p-Cl | $CH_3$ | Phenyl | 5 (100) |
| 31 | Cl | — | H | H | H | $C_2H_5$ | Phenyl | 3 (30), 6 (70) |
| 32 | CN | — | H | H | $OCH_3$ | $CH_3$ | $C_4H_9$ | 3 (20), 10 (60), 5 (20) |
| 33 | $NO_2$ | — | H | H | H | " | Cyclo-hexyl | 3 (15), 5 (85) |
| 34 | $N(CH_3)_2$ | — | H | H | H | $C_4H_9$ | Phenyl | 9 (100) |

*) Isomer mixture in each case
For explanation of solvents, see Tables 1 and 2, 11 = Fish oil

EXAMPLES 35 TO 58

The procedure was as in Examples 1 to 17, but the particular colour donor mixtures stated were employed. The results were analogous to Examples 7 to 17. The solvents used are explained in Tables 1 and 2.

EXAMPLE 35

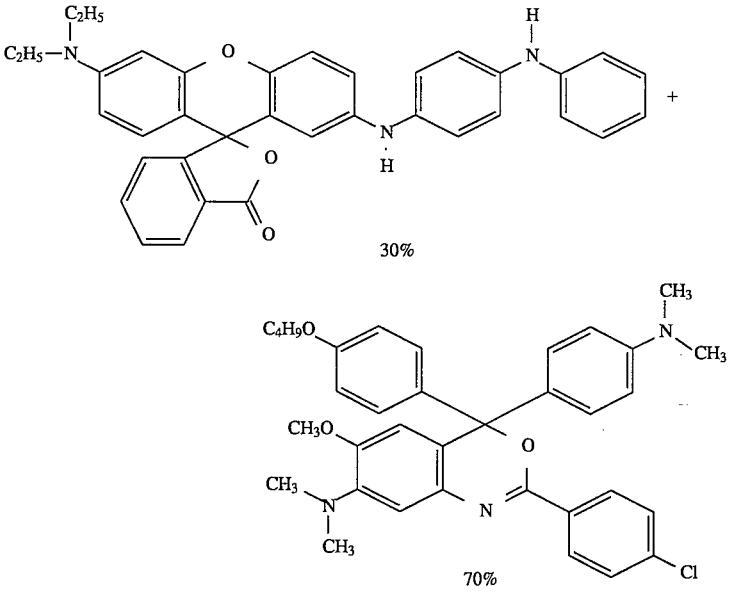

Solvent: 3 (20%), 5 (80%)

EXAMPLE 36
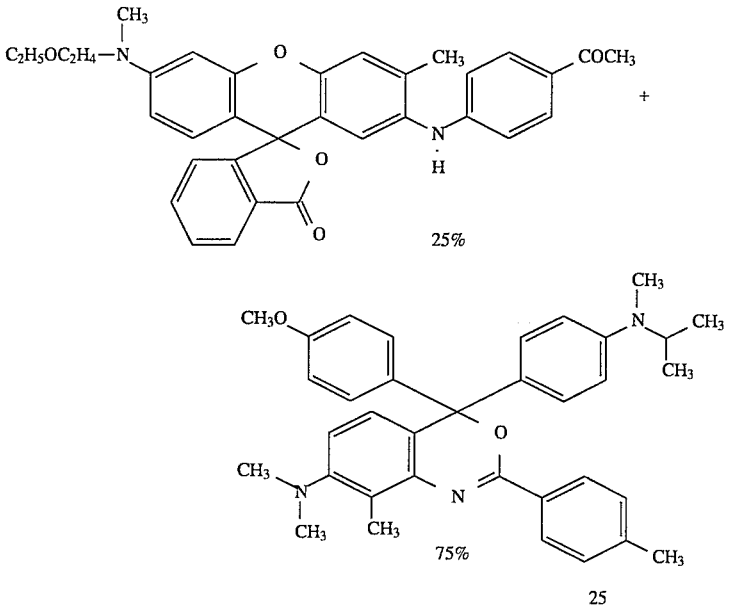
Solvent: 3 (10%), 5 (70%), 10 (20%)
EXAMPLE 37
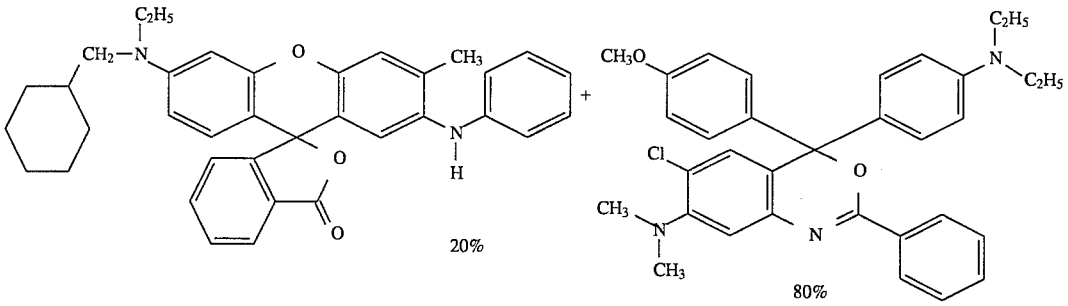
Solvent: 1 (40%), 5 (60%)
EXAMPLE 38
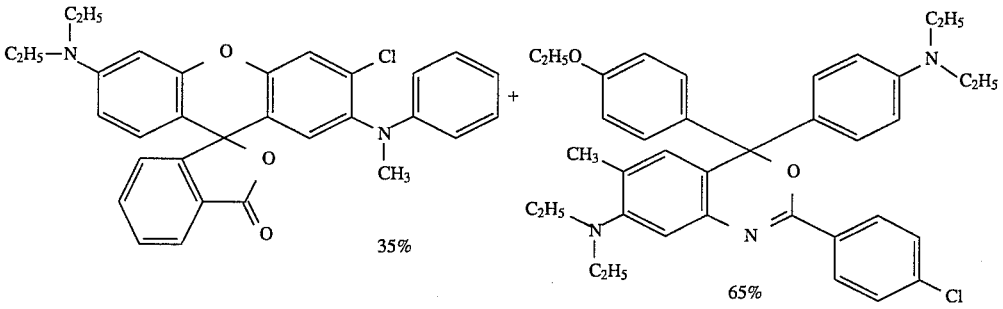
Solvent: 3 (30%), 9 (40%), 11 (30%)

EXAMPLE 39
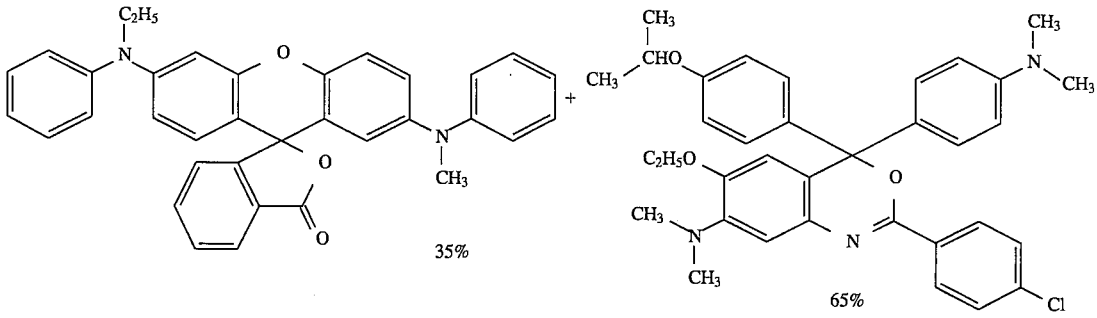
Solvent: 5 (100%)
EXAMPLE 40
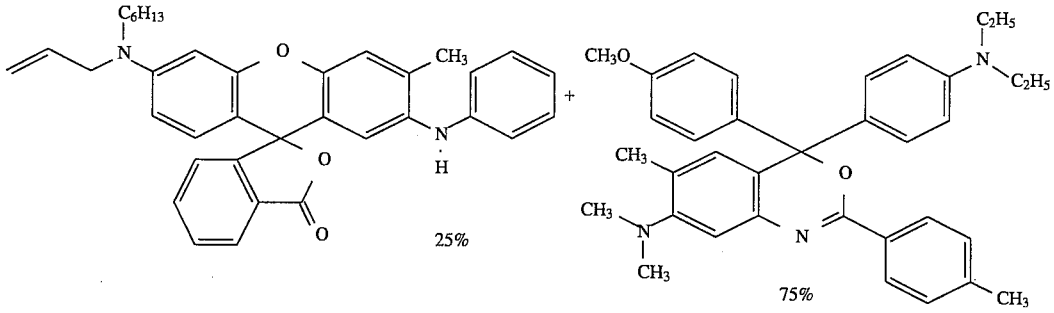
Solvent: 2 (40%) , 7 (30%) , 10 (30%)
EXAMPLE 41
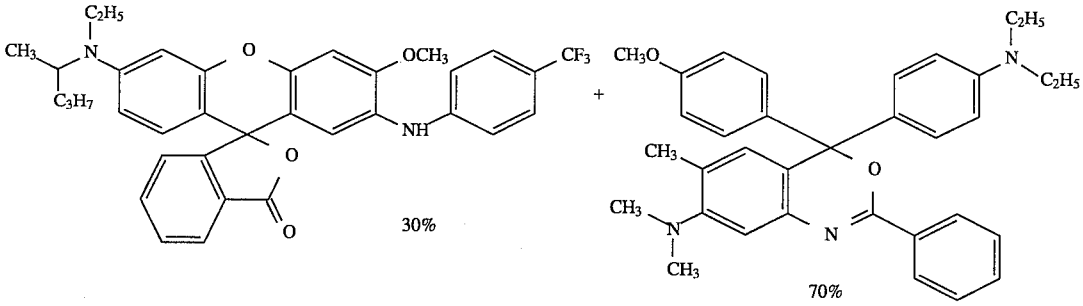
Solvent: 3 (10%), 8 (80%), 9 (10%)

EXAMPLE 42
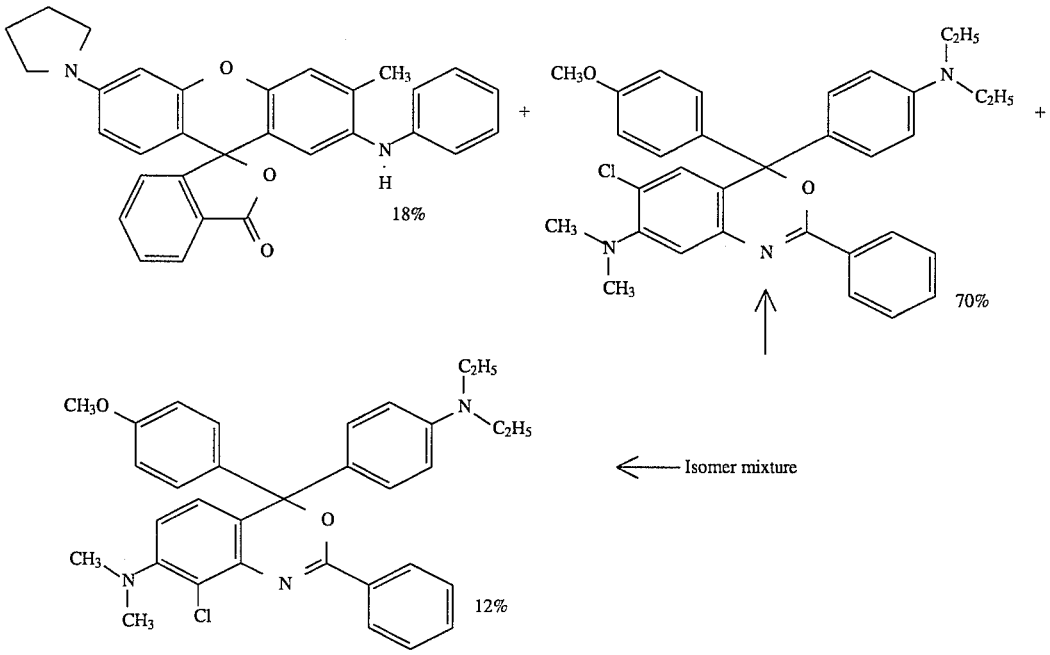
Solvent: 1 (30%), 2 (15%), 6 (55%)
EXAMPLE 43
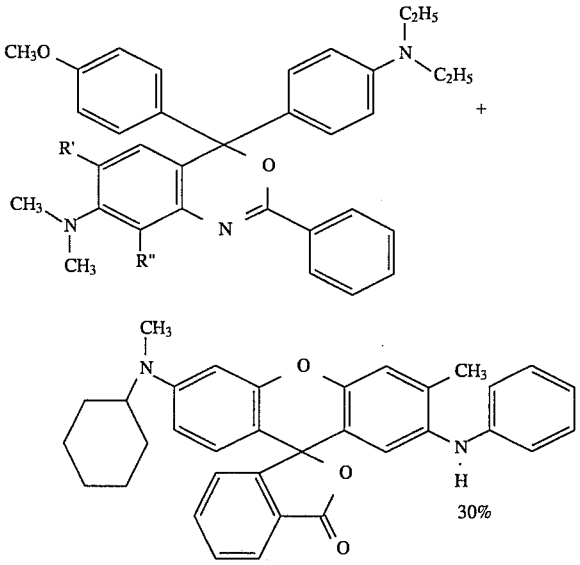
R'=$CH_3$, R"=H 63% R'=H, R"=$CH_3$7% Solvent: 2 (30%), 5 (70%)
EXAMPLE 44
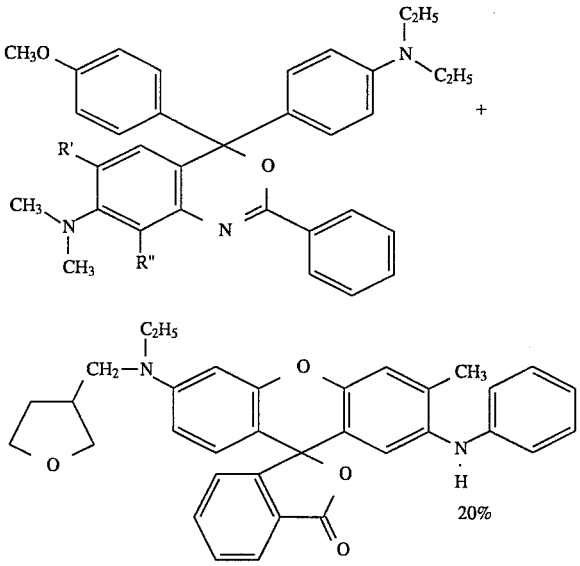
R'=$CH_3$, R"=H 72% R'=H, R"=$CH_3$ 8% Solvent: 9 (100%)

EXAMPLE 45
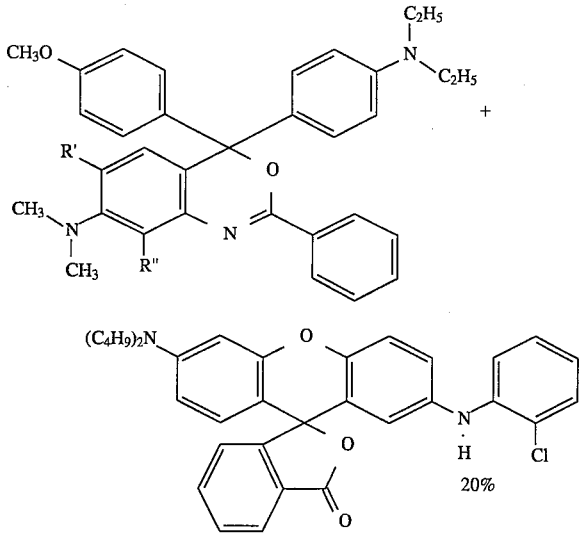
$R'=CH_3$, $R''=H$ 72% $R'=H$, $R''=CH_3$ 8% Solvent: 3 (40%), 5 (60%)
EXAMPLE 46
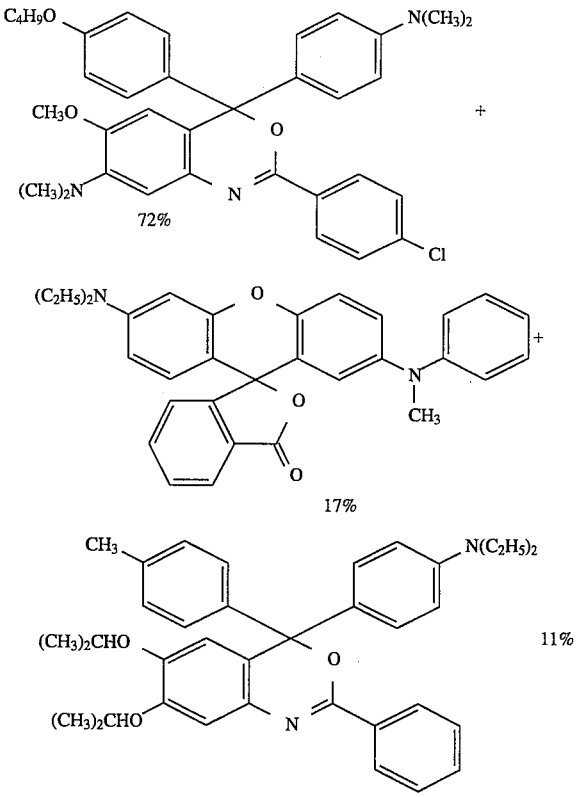
Solvent: 3 (30%), 5 (70%)
EXAMPLE 47
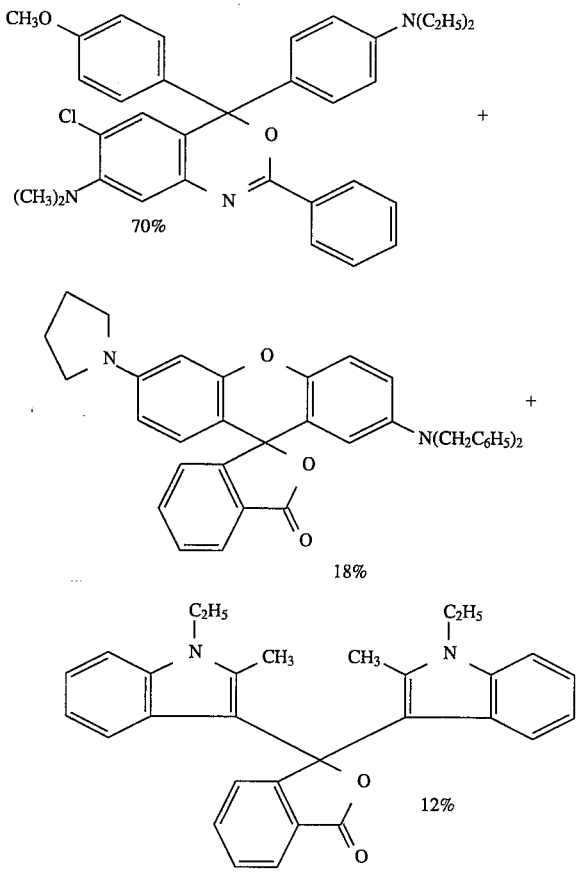
Solvent: 6 (100%)

EXAMPLE 48
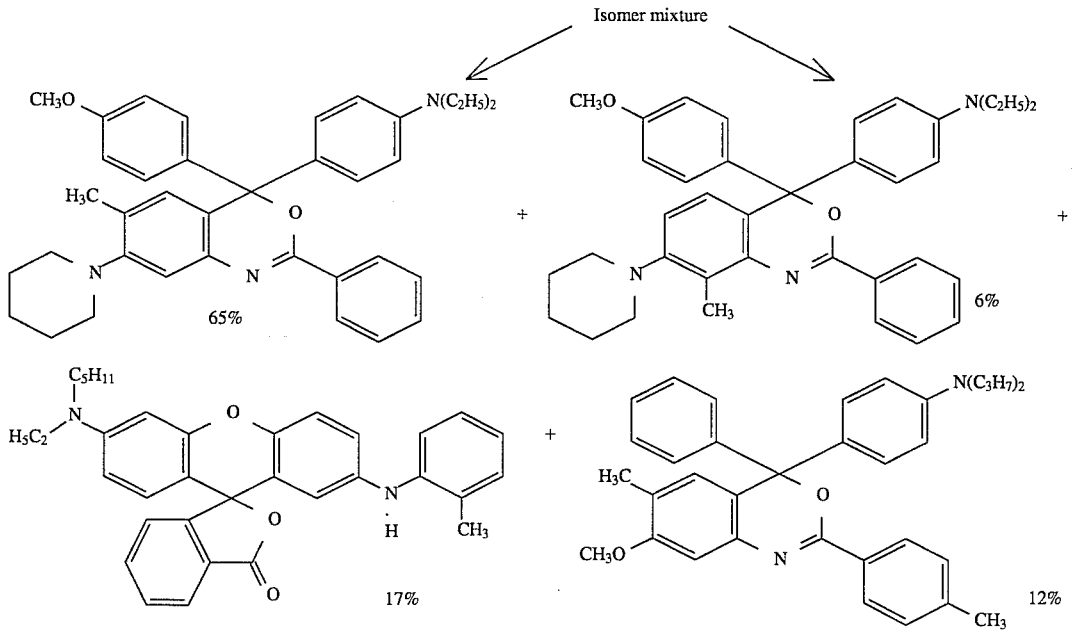
Solvent: 3 (40%), 7 (30%), 8 (30%)
EXAMPLE 49
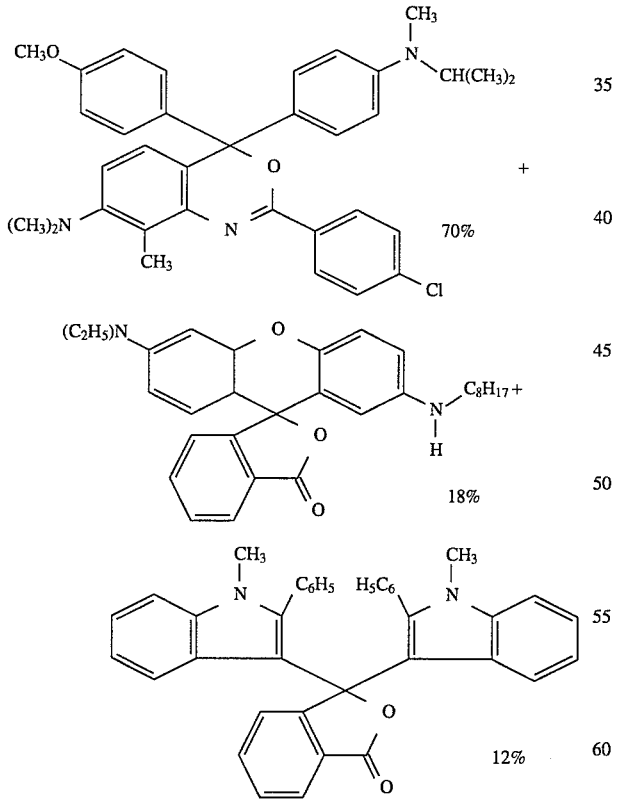
Solvent: 2 (20%), 5 (80%)

EXAMPLE 50
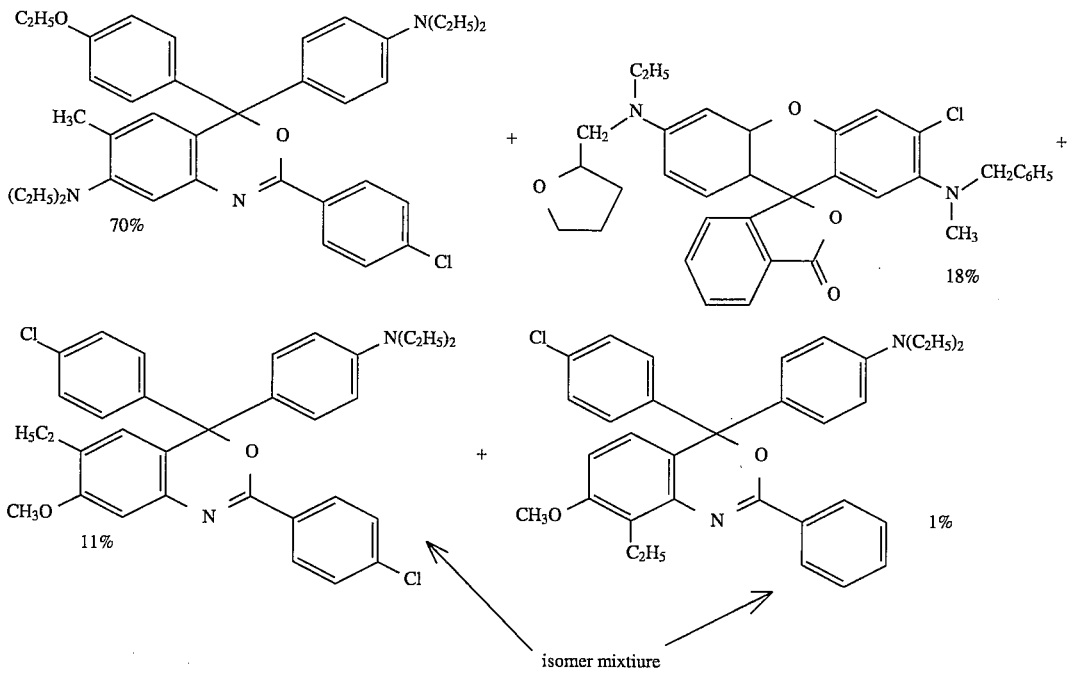
Solvent: 3 (20%), 5 (80%)
EXAMPLE 51
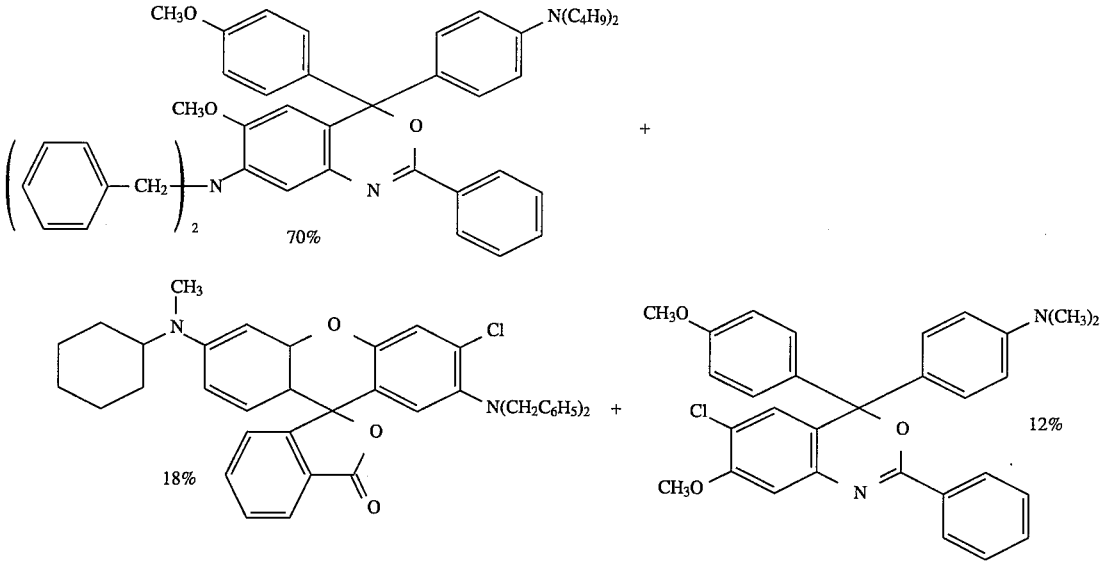
Solvent: 3 (30%), 10 (70%)

EXAMPLE 52
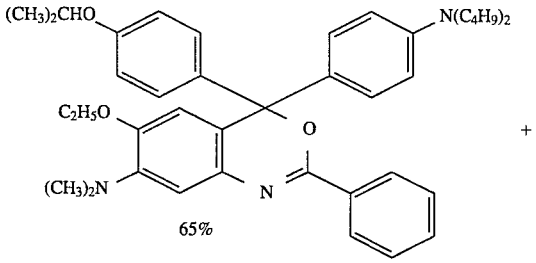
65%
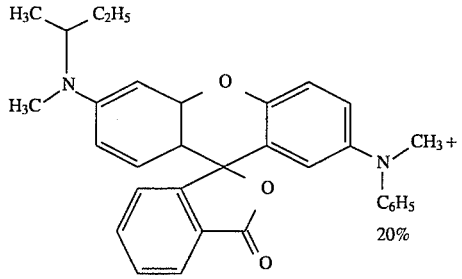
20%
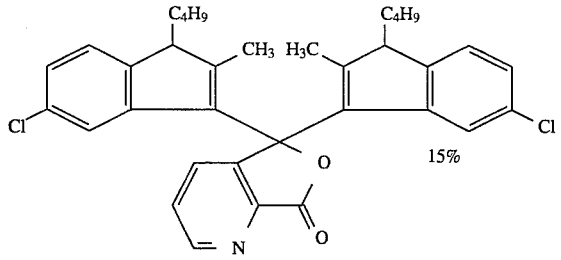
15%
Solvent: 1 (40%), 6 (40%), 5 (20%)
EXAMPLE 53
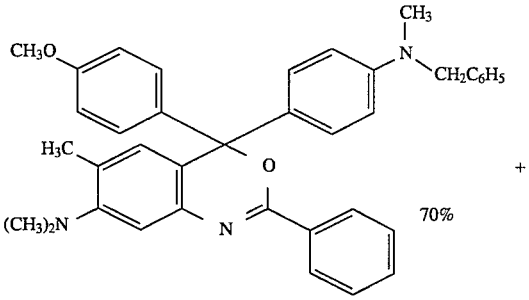
70%
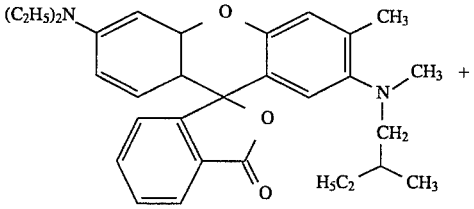
18%
-continued
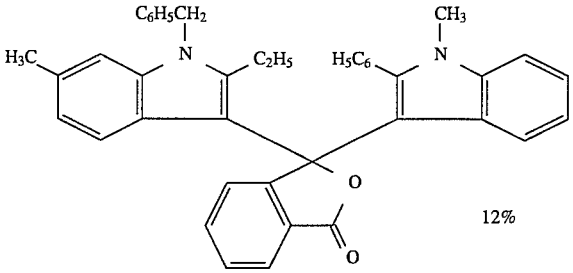
12%
Solvent: 8 (100%)
EXAMPLE 54
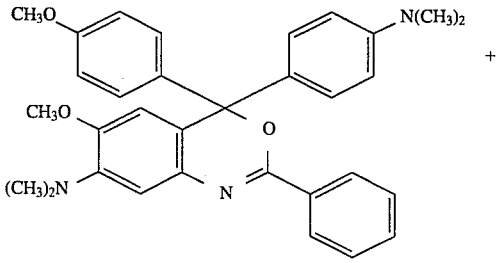
70%
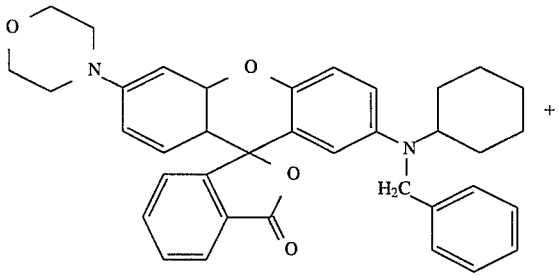
-18%
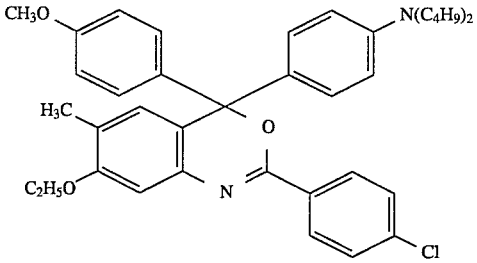
12%
Solvent: 1 (20%), 3 (20%), 5 (60%)
EXAMPLE 55
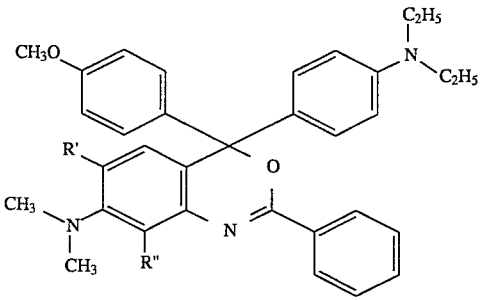

-continued
Colour-forming agent 4 +
10%
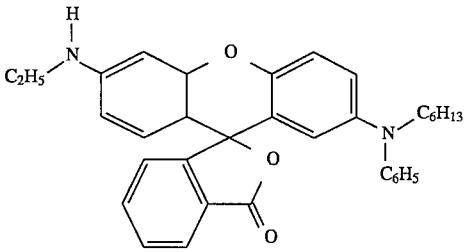
20%
R'=$CH_3$ and R"=H 70% Solvent: 5 (100%)
EXAMPLE 56
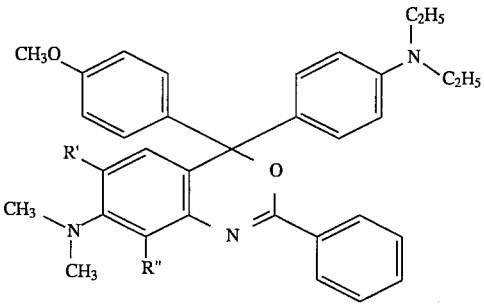
-continued
Colour-forming agent 5 +
13%
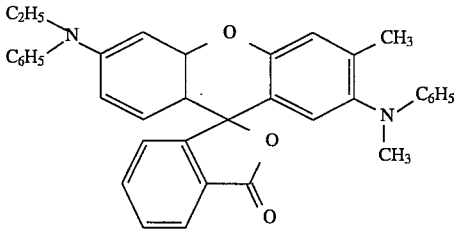
17%
R'=$CH_3$ and R"=H 70% Solvent: 2 (30%), 5 (70%)
EXAMPLE 57
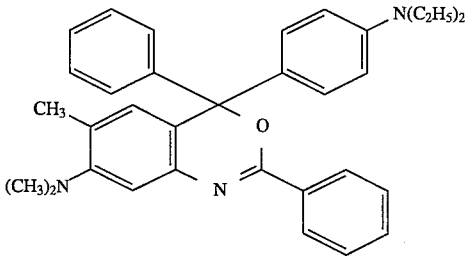
45%
+
Isomer mixture
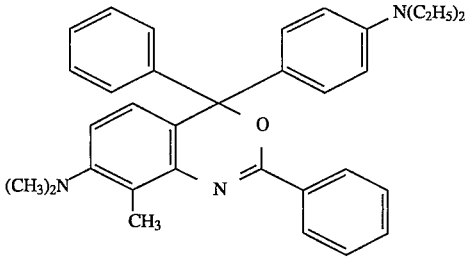
5%
+
Colour-forming agent 2 25% +

-continued

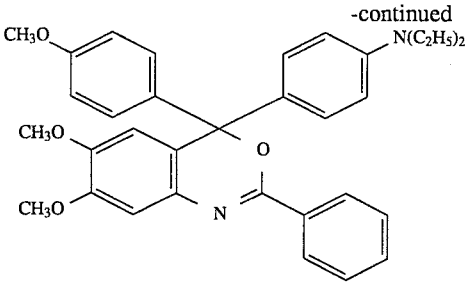

25%

Solvent: 3 (20%), 9 (60%), 5 (20%)

EXAMPLE 58

Colour-forming agent 4 +

20 %

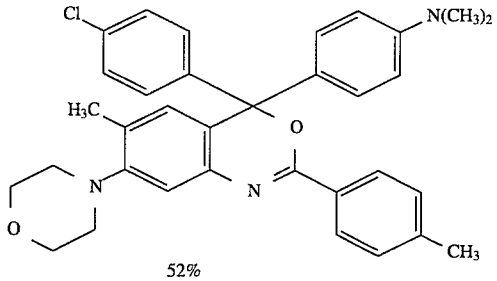

52%

+

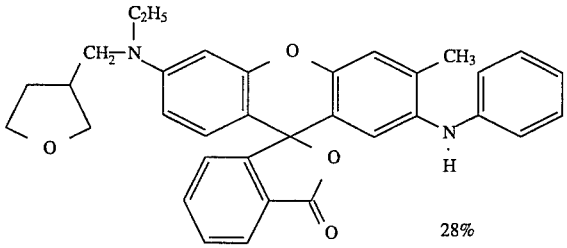

28%

Solvent: 3 (20%), 5 (80%)

What is claimed is:

1. A pressure-sensitive recording material which comprises a support carrying a colour donor, which colour donor is in microencapsulated form and dissolved in a solvent, at least one 3,1-benzoxazine of the formula (I)

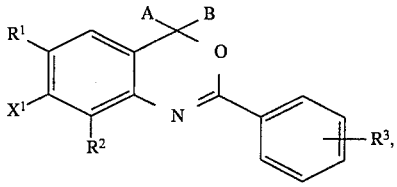

(I)

in which

A denotes a radical of the formulae (II) or (III) and

B denotes a radical of the formulae (III) or (IV)

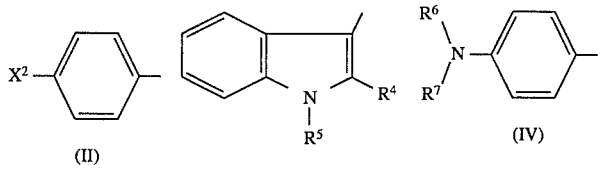

(II) (III) (IV)

$X^1$ denotes hydrogen, halogen, nitro, cyano, $C_1$–$C_4$-alkyl, $OR^8$ or $NR^9R^{10}$, $X^2$ denotes hydrogen, halogen, $C_1$–$C_4$-alkyl or $OR^8$, $R^1$ to $R^3$ independently of one another in each case denote hydrogen, halogen, $C_1$–$C_4$-alkyl or $OR^8$ and $R^4$ to $R^{10}$ independently of one another in each case denote $C_1$–$C_8$-alkyl, cyclohexyl, benzyl or phenyl, wherein the groups $NR^6R^7$ and $NR^9R^{10}$ independently of one another can in each case also denote pyrrolidino, piperidino or morpholino, with the proviso that the following do not occur simultaneously:

A represents a radical of the formula (II),

B represents a radical of the formula (IV), $X^1$ represents dimethylamino, $X^2$ represents methoxy, $R^3$ represents hydrogen, $R^6$ and $R^7$ represent ethyl and one of the radicals $R^1$ and $R^2$ represents methyl and the other represents hydrogen, in which the solvent comprises at least one natural oil or ester of a fatty acid of a natural oil.

2. The pressure-sensitive recording material of claim 1, in which the solvent consists of at least one natural oil or ester of a fatty acid of a natural oil.

3. The pressure-sensitive recording material of claim 1, in which the solvent comprises at least one of coconut oil, palm oil, sunflower oil, rapeseed oil, olive oil, sesame oil, soya oil, linseed oil, castor oil, cottonseed oil, groundnut oil, fish oil, or ester of a fatty acid of one of the forgoing oils.

4. The pressure-sensitive recording material of claim 1, in which the solvent comprises a mixture of (i) at least one of coconut oil, palm oil, sunflower oil, rapeseed oil, olive oil, sesame oil, soya oil, linseed oil, castor oil, cottonseed oil, groundnut oil, fish oil, or ester of a fatty acid of one of the forgoing oils with (ii) at least one paraffinic or aromatic hydrocarbon.

5. The pressure-sensitive recording material of claim 1, in which the solvent comprises (i) a mixture of at least one of coconut oil, palm oil, rapeseed oil or soya oil, with (ii) a paraffinic hydrocarbon.

6. The pressure-sensitive recording material of claim 1, in which the solvent comprises (i) a mixture of at least two of coconut oil, palm oil, rapeseed oil, sesame oil and soya oil with (ii) a paraffinic hydrocarbon.

7. The pressure-sensitive recording of claim 1, in which the solvent comprises coconut oil and a branched paraffinic hydrocarbon.

8. The pressure-sensitive recording material of claim 1, which comprises, as the colour donor, at least 50% by weight of 3,1-benzoxazines of the formula (I) and in addition not more than 2 compounds from the group consisting of fluoranes of the formulae (V) and (VI) and diindolyllactones of the formula (VII)

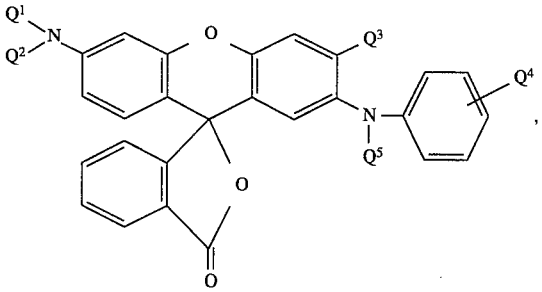

(V)

$Q^1$ and $Q^2$ independently of one another in each case denote hydrogen, straight-chain or branched $C_1$–$C_8$-allyl, allyl, cyclopentyl or cyclohexyl, it being possible for alkyl groups to be optionally substituted by up to 3 identical or different substituents from the group consisting of $C_1$–$C_3$-alkoxy, cyclohexyl, phenyl, furanyl, pyrrolyl and pyridinyl and it also being possible for furanyl, pyrrolyl and pyridinyl to be present for furanyl, pyrrolyl and pyridinyl to be present in completely or partly hydrogenated form, or $NQ^1Q^2$ together denote pyrrolidino, piperidino or morpholino, $Q^3$ denotes hydrogen, methyl, methoxy or chlorine, $Q^4$ denotes hydrogen, methyl, trifluoromethyl, fluorine, chlorine, acetyl, cyano or anilino and $Q^5$ denotes hydrogen, methyl, ethyl or benzyl,

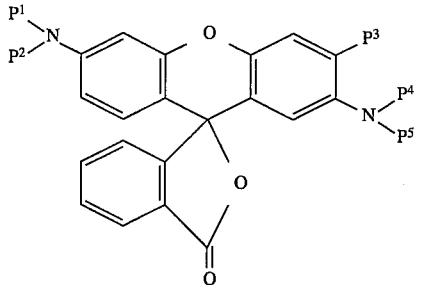

(VI)

$P^1$, $P^2$, $P^4$ and $P^5$ independently of one another in each case denote hydrogen, straight-chain or branched $C_1$–$C_{12}$-alkyl, allyl, cyclopentyl, cyclohexyl or phenyl, it being possible for alkyl groups to be optionally substituted by up to 3 identical or different substituents from the group consisting of $C_1$–$C_3$-alkoxy, cyclohexyl, phenyl, furanyl, pyrrolyl and pyridinyl and for phenyl groups to be optionally substituted by up to 2 identical or different substituents from the group consisting of methyl, methoxy and chlorine, and it also being possible for furanyl, pyrrolyl and pyridinyl to be present in completely or partly hydrogenated form, or $NP^1P^2$ together denotes pyrrolidino, piperidino or morpholino, and $P^3$ denotes hydrogen, methyl, methoxy or chlorine,

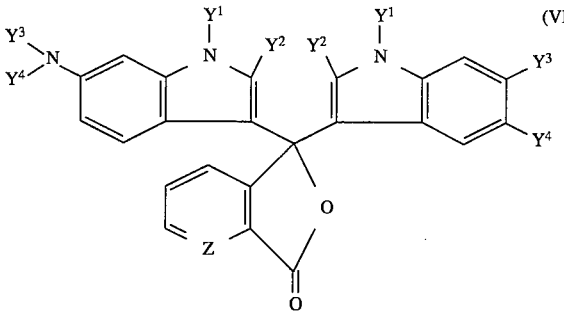

(VII)

$Y^1$ denotes straight-chain or branched $C_1$–$C_{12}$-alkyl, benzyl or phenethyl, $Y^2$ denotes hydrogen, straight-chain or branched $C_1$–$C_4$-alkyl or phenyl, $Y^3$ and $Y^4$ independently of one another in each case denote hydrogen, chlorine, methyl or methoxy and Z denotes CH or N.

9. The pressure-sensitive recording material of claim 1, in which, in the formulae (I) to (IV), $X^1$ denotes hydrogen, chlorine, nitro, cyano, methyl, ethyl, methoxy, ethoxy, dimethylamino, diethylamino, N-methyl-N-cyclohexylamino, dibenzylamino, N-methyl-N-phenyiamino, pyrrolidino, piperidino or morpholino, $X^2$ denotes hydrogen, chlorine, methyl, ethyl, methoxy, ethoxy, benzyloxy or phenoxy, $R^1$ to $R^3$ independently of one another in each case denote hydrogen, chlorine, methyl or methoxy, $R^4$ denotes methyl, ethyl, propyl, butyl, pentyl, hexyl, octyl or benzyl, $R^5$ denotes methyl, ethyl, cyclohexyl, or phenyl and the group $NR^6R^7$ denotes dimethylamino, diethylamino, dibenzylamino, N-methyl-N-phenylamino, pyrrolidino, piperidino or morpholino, with the proviso that the following do not occur simultaneously:

A represents a radical of the formula (II),

B represents a radical of the formula (IV), $X^1$ represents dimethylamino, $X^2$ represents methoxy, $R^3$ represents hydrogen, $R^6$ and $R^7$ represent ethyl and one of the radicals $R^1$ and $R^2$ represents methyl and the other represents hydrogen.

10. The pressure-sensitive recording material of claim 1, in which in formula (I), A denotes a radical of the formula (II) and B denotes a radical of the formula (IV), $X^1$ denotes methoxy, ethoxy, benzyloxy, dimethylamino, pyrrolidino, piperidino or morpholino, $X^2$ denotes hydrogen, chlorine, methyl, methoxy, ethoxy or benzyloxy, $R^2$ and $R^3$ denote hydrogen, $R^1$ denotes chlorine, methyl or methoxy and the group $NR^6R^7$ denotes dimethylamino, diethylamino, dibenzylamino, pyrrolidino, piperidino or morpholino, with the proviso that the following do not occur simultaneously: $X^1$ represents dimethylamino, $X^2$ represents methoxy, $R^1$ represents methyl and $NR^6R^7$ represents diethylamino.

11. The pressure-sensitive recording material of claim 1, which comprises, as the colour donor, $a^1$) a 3,1-benzoxazine of the formula (I) wherein $X^1$ denotes dimethylamino, pyrrolidino, piperidino or morpholino and $X^2$ denotes methoxy, ethoxy or benzyloxy and the other radicals have the meaning given in claim 7, or $a^2$) an isomer mixture of 3,1-benzoxazines of the formula (I), wherein, in one isomer, $R^1$ denotes chlorine, methyl or methoxy and $R^2$ denotes hydrogen, and in the other isomer, $R^1$ denotes hydrogen and $R^2$ denotes chlorine, methyl or methoxy, and in both isomers $X^1$ and $X^2$ have the meaning given above for $a^1$) and the other radicals have the meaning given in claim 7 and b) a fluorane of the formula (V) wherein $Q^1$ and $Q^2$ independently of one another in each case denote hydrogen, methyl, ethyl, 1- or 2-propyl, 1- or 2-butyl, 2-methyl-1-butyl, 1-, 2- or 3-pentyl, 3-methyl-1-butyl, 2 -ethyl-1-propyl, 1-, 2- or 3-hexyl, 3-methyl -1-pentyl, 2-methoxyethyl, 2-ethoxyethyl, 3-methoxypropyl, 3-ethoxypropyl, 4-methoxybutyl, 4-ethoxybutyl, cyclohexylmethyl, benzyl, furfuryl, pyrrolidin-2-yl-methyl, 2 -(2- or 4-pyridyl)-ethyl, allyl, cyclopentyl or cyclohexyl, or $NQ^1Q^2$ together denotes pyrrolidino, piperidino or morpholino, $Q^3$ denotes hydrogen, methyl or chlorine, $Q^4$ denotes hydrogen, methyl, fluorine, chlorine or anilino and $Q^5$ denotes hydrogen or methyl.

12. The pressure-sensitive recording material of claim 1, which comprises, as the colour donor, a) a 3,1-benzoxazine as described in claim 11 under $a^1$) or an isomer mixture of 3,1-benzoxazines as described in claim 11 under $a^2$) and b) a fluorane of the formula (VI) wherein $P^1$, $P^2$, $P^4$ and $P^5$ independently of one another in each case denote hydrogen, methyl, ethyl, 1- or 2-propyl, 1- or 2-butyl, 2-methyl-1-butyl, 1-, 2 -or 3-pentyl, 3-methyl-1-butyl, 2-ethyl-1-propyl, 1-, 2- or 3-hexyl, 4-methyl-1-pentyl, 4-methoxyethyl, 3-ethoxy-ethyl, 3-methoxypropyl, 4-methoxybutyl, 4-ethoxy-butyl, cyclohexylmethyl, benzyl, furfuryl, pyrrol-idin-2-yl-methyl, 2-(2 - or 4-pyridyl)-ethyl, allyl, cyclopentyl, cyclohexyl, phenyl, 2- or 4-chloro-phenyl, 2- or 4 -tolyl or 2- or 4-anisyl, or $NP^1P^2$ together denotes pyrrol-idino, piperidino or morpholino, and $P^3$ denotes hydrogen, methyl or chlorine, and $c^1$) a further benzoxazine of the formula (I) wherein $X^1$ and $X^2$ independently of one another denote methoxy, ethoxy or benzyloxy and the other radicals have the meaning given in claim 7, or $c^2$) an isomer mixture of 3,1-benzoxazines of the formula (I) wherein in one isomer $R^1$ denotes chlorine, methyl and methoxy and $R^2$ denotes hydrogen and in the other isomer $R^1$ denotes hydrogen and $R^2$ denotes chlorine, methyl or methoxy, and $X^1$ and $X^2$ have the meaning given above for $c^1$) and the other radicals have the meaning given in claim 10, or $c^3$) a diindolyllactone of the formula (VII) wherein $Y^1$ denotes methyl, ethyl, 1- or 2-propyl, 1- or 2-butyl, 1- or 2-pentyl, 1- or 2-hexyl, 1 - or 2-heptyl, 1- or 2-octyl or benzyl, $Y^2$ denotes hydrogen, methyl, ethyl, 1-propyl, 1-butyl or phenyl, $Y^3$ and $Y^4$ independently of one another in each case denote hydrogen, chlorine, methyl or methoxy and Z denotes CH or N.

13. The pressure-sensitive recording material of claim 1, which comprises, as the colour donor, a 3,1-benzoxazine of the formula (I) wherein $X^1$ denotes dimethylamino, pyrrolidino, piperidino or morpholino and $X^2$ denotes hydrogen, chlorine or methyl and the other radicals have the meaning given in claim 10, or an isomer mixture of 3,1-benzoxazines of the formula (I) wherein in one isomer $R^1$ denotes chlorine, methyl or methoxy and $R^2$ denotes hydrogen and in the other isomer $R^1$ denotes hydrogen and $R^2$ denotes chlorine, methyl or methoxy, and in both isomers $X^1$ and $X^2$ have the meaning given immediately above and the other radicals have the meaning given in claim 10.

14. Pressure-sensitive recording material of claim 1, in which the microcapsule has a shell which consists of a polyaddition product of a polyisocyanate and a polyamine.

* * * * *

UNITED STATES PATENT AND TRADEMARK OFFICE

CERTIFICATE OF CORRECTION

PATENT NO. : 5,552,365

DATED : September 3, 1996

INVENTOR(S) : Berneth, et al.

It is certified that error appears in the above-indentified patent and that said Letters Patent is hereby corrected as shown below:

| | |
|---|---|
| Col. 33, line 27 | Delete " -allyl " (first occurrence) and substitute -- -alkyl -- |
| Col. 33, lines 32-33 | Delete " for furanyl, pyrrolyl and pyridinyl to be present " (second occurrence) |

Signed and Sealed this

Twenty-fifth Day of February, 1997

*Attest:*

*Attesting Officer*

BRUCE LEHMAN

*Commissioner of Patents and Trademarks*